US011000747B2

(12) United States Patent
Elpers et al.

(10) Patent No.: US 11,000,747 B2
(45) Date of Patent: May 11, 2021

(54) BASKETBALL RIM ASSEMBLIES

(71) Applicant: Indian Industries, Inc., Evansville, IN (US)

(72) Inventors: Philip Elpers, Evansville, IN (US); Clay Seitz, Newburgh, IN (US); Robert W. Cornell, Evansville, IN (US)

(73) Assignee: Indian Industries, Inc., Evansville, IN (US)

( * ) Notice: Subject to any disclaimer, the term of this patent is extended or adjusted under 35 U.S.C. 154(b) by 0 days.

(21) Appl. No.: 16/507,491

(22) Filed: Jul. 10, 2019

(65) Prior Publication Data

US 2020/0114232 A1 Apr. 16, 2020

Related U.S. Application Data

(60) Provisional application No. 62/745,592, filed on Oct. 15, 2018.

(51) Int. Cl.
*A63B 63/08* (2006.01)

(52) U.S. Cl.
CPC ..... *A63B 63/083* (2013.01); *A63B 2063/086* (2013.01); *A63B 2210/50* (2013.01); *A63B 2225/093* (2013.01)

(58) Field of Classification Search
CPC ..... A63B 63/08
See application file for complete search history.

(56) References Cited

U.S. PATENT DOCUMENTS

| | | | | | |
|---|---|---|---|---|---|
| 1,157,333 | A | * | 10/1915 | Snell | A01K 5/01 248/291.1 |
| 1,549,660 | A | | 8/1925 | Ericson | |
| 1,565,118 | A | | 12/1925 | Stugard | |
| 2,596,543 | A | | 5/1952 | Fox | |
| 3,375,004 | A | | 3/1968 | Ebstein | |
| 3,788,642 | A | | 1/1974 | Matras et al. | |
| 4,194,734 | A | | 3/1980 | Tyner | |
| 4,365,802 | A | | 12/1982 | Ehrat | |
| 4,438,923 | A | * | 3/1984 | Engle | A63B 63/083 473/486 |
| 4,534,556 | A | * | 8/1985 | Estlund | A63B 63/083 473/486 |
| 4,676,503 | A | * | 6/1987 | Mahoney | A63B 63/083 473/486 |

(Continued)

FOREIGN PATENT DOCUMENTS

CN 206587369 U 10/2017

*Primary Examiner* — Eugene L Kim
*Assistant Examiner* — Christopher Glenn
(74) *Attorney, Agent, or Firm* — Woodard, Emhardt, Henry, Reeves & Wagner, LLP

(57) ABSTRACT

Basketball goals may incorporate folding rim assemblies which can be packaged and transported pre-mounted to certain backboard assemblies. Alternately, folding rim assemblies can be sold separately or packaged with a backboard for on-site mounting. Some basketball rim assembles may incorporate a break-away mechanism using a leaf spring. The leaf spring biases the rim bracket and resiliently resists downward pivotal movement of the rim bracket and rim. When the rim is rotated downward under an applied force, the leaf spring is flexed, biasing the rim to return to a static playing position when the force is removed.

10 Claims, 12 Drawing Sheets

(56) References Cited

U.S. PATENT DOCUMENTS 4,739,988 A * 4/1988 Schroeder ..... A63B 63/083 473/481
4,846,469 A * 7/1989 Nye ..... A63B 63/083 473/486
5,066,007 A 11/1991 Niver
5,071,120 A * 12/1991 Dadbeh ..... A63B 63/083 473/486
5,106,084 A * 4/1992 Vaught ..... A63B 63/083 384/297
5,356,001 A 10/1994 Luna
5,374,055 A * 12/1994 Tung ..... A63B 63/083 16/328
5,464,207 A * 11/1995 Boitano ..... A63B 63/083 473/486
5,480,139 A * 1/1996 Owen, Jr. ..... A63B 63/083 473/485
5,586,759 A * 12/1996 Fitzsimmons ..... A63B 63/083 473/486
5,730,667 A * 3/1998 Jones ..... A63B 63/083 473/447
5,816,955 A * 10/1998 Nordgran ..... A63B 63/083 473/486
5,830,090 A 11/1998 Fitzsimmons et al.
5,842,941 A 12/1998 Siminski et al.
5,893,809 A 4/1999 Coats et al.
5,902,197 A * 5/1999 Davis ..... A63B 63/083 473/479
5,947,847 A * 9/1999 van Nimwegen ... A63B 63/083 473/481
6,080,071 A * 6/2000 Childers ..... A63B 63/083 473/486
6,186,911 B1 * 2/2001 Manthey ..... A63B 65/08 473/486
6,296,583 B1 * 10/2001 Tatar, Sr. ..... A63B 63/083 473/486
6,447,409 B1 9/2002 Squibb
6,503,160 B2 1/2003 Hehr
6,935,972 B2 8/2005 Hehr
7,048,655 B2 5/2006 Nye et al.
7,097,574 B2 8/2006 Nye et al.
7,175,551 B1 2/2007 Hamilton
7,195,571 B2 * 3/2007 Nye ..... A63B 63/083 473/479
7,214,148 B2 5/2007 Mahoney
7,604,555 B2 10/2009 Nye
7,628,718 B2 12/2009 Connerley
7,798,921 B2 9/2010 Connerley
8,454,460 B2 6/2013 Connerley
8,852,034 B2 10/2014 Stevens
9,415,285 B1 * 8/2016 Jolly ..... A63B 63/083
10,052,540 B2 8/2018 Elpers et al.
2002/0187865 A1 * 12/2002 Hehr ..... A63B 63/083 473/486
2003/0054906 A1 3/2003 Allshouse et al.
2007/0167265 A1 * 7/2007 Connerley ..... A63B 63/083 473/485
2012/0202624 A1 8/2012 Davis
2012/0244965 A1 * 9/2012 Connerley ..... A63B 63/083 473/486
2015/0231466 A1 * 8/2015 Rickard ..... A63B 63/083 473/448
2015/0367213 A1 12/2015 Olsen et al.
2017/0007895 A1 1/2017 Elpers et al.
2017/0007896 A1 1/2017 Elpers et al.

* cited by examiner

BASKETBALL RIM ASSEMBLIES

The present application claims priority to provisional application Ser. No. 62/745,592 filed on Oct. 15, 2018, which is incorporated by reference.

FIELD OF THE DISCLOSURE

The present disclosure deals with basketball goal assemblies and particularly basketball rim assemblies.

BACKGROUND

Basketball is a popular sport that can be played by anyone who has access to a ball and a basketball goal. Basketball goals have become common to find in driveways and public parks. For such goals to be assembled and/or installed they need to be packaged and transported to the desired location either by a consumer or an installer. It can then take time for the consumer or installer to assembly the various components into an assembled basketball goal. Furthermore, assembled and/or installed goals can take up significant space even when not in use.

For game play, the basketball rim assembly needs to be securely mounted to extend perpendicular to the face of the basketball backboard. In certain arrangements a rim assembly may incorporate a break-away feature, allowing the rim to resiliently pivot downward a short distance when impacted by a force, such as a player hanging from the rim. The rim assembly returns to a static playing position when the force is released. However, the inclusion of a break-away feature typically significantly increases the bulk and complexity of the rim assembly.

To facilitate assembly and installation of the goal, it would be desirable in some situations for the basketball rim assembly to arrive already connected to the backboard. However, since the rim assembly typically extends perpendicular to the backboard, a pre-attached fixed rim assembly can make packaging and transport unwieldy and impractical. Further, an extending rim assembly can require more room for storage. Some prior art references suggest arrangements where a rim assembly can be folded upward and parallel to the backboard so that the rim assembly does not protrude when not in use. However, such upward folding arrangements are often incompatible with break-away mechanisms which allow downward pivoting.

Some basketball rim assemblies include a break-away mechanism based on a coil spring arrangement. In representative examples, one or more coil springs are arranged with the spring axis perpendicular to the basketball rim or with an axis perpendicular to the backboard. A shaft, such as a bolt extends through the central axis of the coil spring. The coil spring is captured with one end bearing against a plate surface of the rim assembly which the shaft passes through. The other spring end is held using a cap arrangement, such as a washer with a diameter larger than the spring which is held on the shaft with a threaded nut or similar fastener. The plate surface is arranged to move along the shaft to compress the spring against the cap arrangement when force is applied.

In some arrangements, the consumer or installer has to assemble the components, including placing each spring over each corresponding shaft and securing it with a cap arrangement. This requires the proper assembly of multiple components, including adjusting the spring tension to provide the correct amount of resistive force, without too much or too little resistance. Alternately, if a coil spring arrangement is transported pre-assembled it adds to the manufacturer's cost, it is transported under significant tension and it is more bulky and awkward to package and transport. Moreover, any arrangement with a coil spring and cap arrangement involves more components, which increases the cost and complexity of assembly. Furthermore, when there are more components, there is an increased chance of components being omitted, getting lost, breaking or loosening over time.

SUMMARY

In certain embodiments, the present disclosure provides rim assemblies which are attached or which are configured to be attached to or with a basketball backboard. The backboard may be mounted to a support member such as a support pole. The basketball goal is arranged to be in a playing position relative to a support surface such as the ground or a floor.

Illustrated embodiments include a rim assembly with a mounting bracket and a rim bracket connected by an axle forming a hinge. The mounting bracket is mountable to the backboard assembly and/or support structure. The rim bracket forms a portion of and/or is connected to a basketball rim. In certain embodiments, the rim bracket is rotatable approximately ninety degrees relative to the mounting bracket between a playing position and a folded position. In the upward or folded position the rim bracket and rim extend substantially parallel to the backboard. In the playing position, the rim bracket and rim extend perpendicular to the backboard.

In certain embodiments, the rim assemblies include a locking mechanism to selectively retain the rim assembly in the folded position or the playing position. In one illustrated embodiment, the locking mechanism includes a pair of retaining pieces such as locking buttons on the ends of respective leaf springs mounted to the rim bracket. The locking buttons resiliently extend laterally through openings in side flanges of the rim bracket. In the respective folded position or playing position, the locking buttons further extend through respective folded position openings or playing position openings in side flanges of the mounting bracket. The rim assembly can be unlocked by resiliently pressing the locking buttons inward from the openings corresponding to the current rim bracket position, allowing the rim bracket to be rotated to the other position, where the locking buttons will extend to engage the other pair of folded position openings or playing positions opening. In certain embodiments where a folding rim assembly also incorporates a break-away mechanism, the playing position openings may be elongated to allow some breakaway movement of the rim during play.

In another illustrated embodiment, the locking mechanism includes a retaining piece such as a retaining pin. Opposing ends of the retaining pin extend laterally through openings in side flanges of the rim bracket and the mounting bracket. The rim assembly can be unlocked by selectively removing the retaining pin, allowing the rim bracket to be rotated from a playing position to a folded position. In certain embodiments where a folding rim assembly also incorporates a break-away mechanism, openings for the retaining pin in the side flanges may be elongated and/or oval shaped to allow some breakaway movement of the rim during play. In an aspect which may be combined or use separately from the folding aspect of the rim assembly, a breakaway mechanism may incorporate an elongate rim leaf spring. The rim leaf spring has a lower end anchored to the mounting bracket. The leaf spring extends upward and a middle portion curves forward. The middle portion may abut the axle, which forces the leaf spring to maintain a curved orientation. An upper end of the rim leaf spring abuts the rim bracket in the playing position. The rim leaf spring biases the rim bracket upward and resists downward pivotal movement. Downward movement may occur when a player hangs from the rim.

In some embodiments the path of the unflexed leaf spring may extend slightly above a plane defined by the rim bracket's playing position, so that the spring contacts the rim bracket and a preload is applied as the rim bracket approaches and is placed into the playing position.

Further objects, features and advantages of the present disclosure shall become apparent from the detailed drawings and descriptions provided herein.

DESCRIPTION OF DISCLOSED EMBODIMENTS

Figure 1:
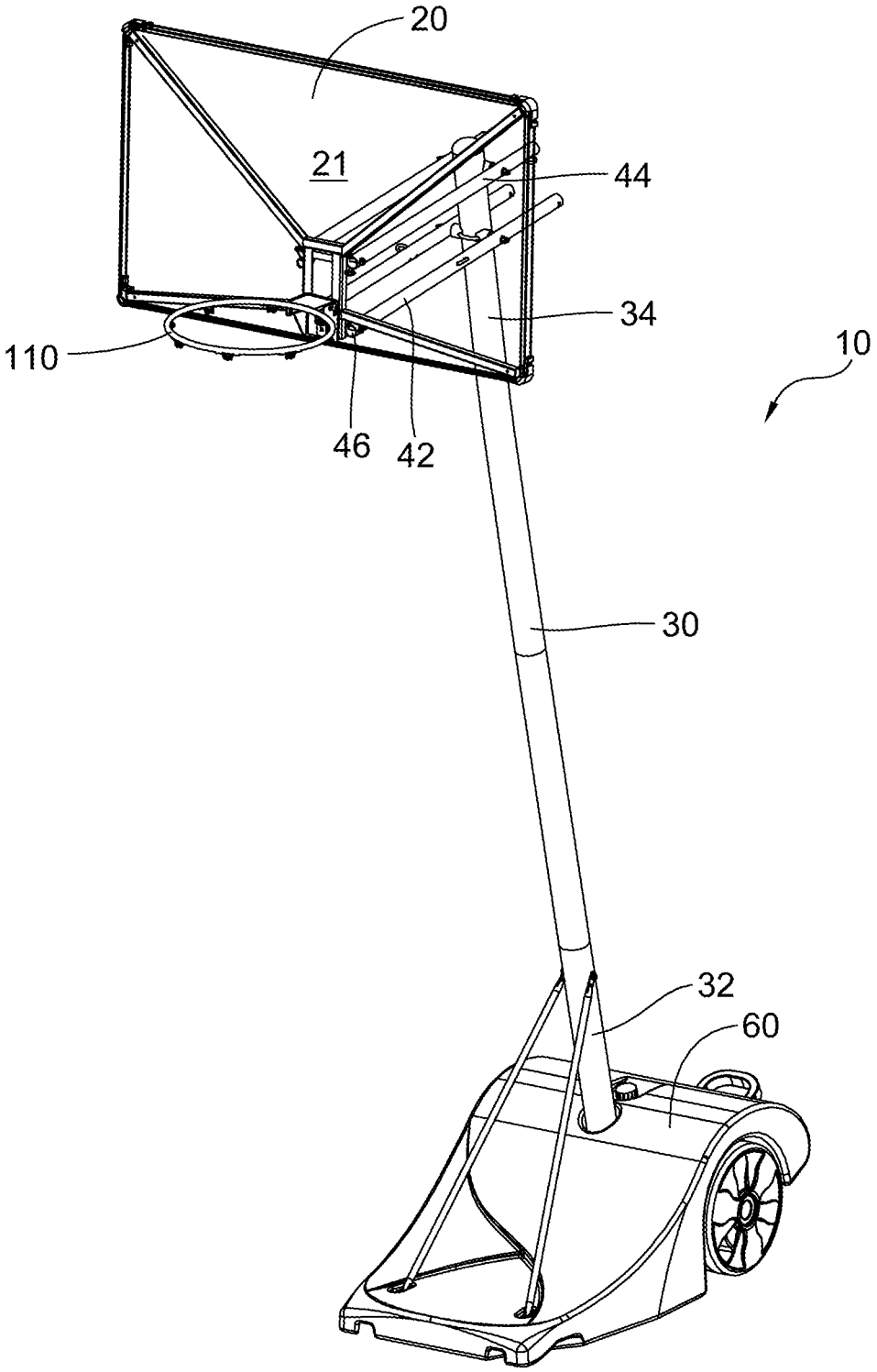
FIG. 1 is a perspective view of a basketball goal assembly incorporating an embodiment of the present disclosure.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended, such alterations and further modifications in the illustrated device, and such further applications of the principles of the disclosure as illustrated therein being contemplated as would no many occur to one skilled in the art to which the disclosure relates.

In certain embodiments, the present disclosure provides rim assemblies which are attached or which are configured to be attached to or with a basketball backboard. The backboard may be mounted to a support member such as a support pole. The basketball goal is arranged to be in a playing position relative to a support surface such as the ground or a floor. Illustrated embodiments include a rim assembly with a mounting bracket and a rim bracket connected by an axle forming a hinge. The mounting bracket is mountable to the backboard assembly and/or support structure. The rim bracket forms a portion of and/or is connected to a basketball rim. In certain embodiments, the rim bracket is rotatable approximately ninety degrees relative to the mounting bracket between a playing position and a folded position. In the upward or folded position the rim bracket and rim extend substantially parallel to the backboard. In the playing position, the rim bracket and rim extend perpendicular to the backboard.

Certain embodiments of the rim assemblies include a locking mechanism to selectively retain the rim assembly in the folded position or the playing position. In one illustrated embodiment, the locking mechanism includes a pair of locking buttons on the ends of respective leaf springs mounted to the rim bracket. The locking buttons resiliently extend laterally through openings in side flanges of the rim bracket. In the respective folded position or playing position, the locking buttons further extend through respective folded position openings or playing positions openings in side flanges of the mounting bracket. The rim assembly can be unlocked by resiliently pressing the locking buttons inward from the openings corresponding to the current rim bracket position, allowing the rim bracket to be rotated to the other position, where the locking buttons will extend to engage the other pair of folded position openings or playing positions openings. In certain embodiments where a folding rim assembly also incorporates a break-away mechanism, the playing position openings may be elongated to allow some breakaway movement of the rim during play.

In another illustrated embodiment, the locking mechanism includes a retaining piece such as a retaining pin. Opposing ends of the retaining pin extend laterally through openings in side flanges of the rim bracket and the mounting bracket. The rim assembly can be unlocked by selectively removing the retaining pin, allowing the rim bracket to be rotated from a playing position to a folded position. In certain embodiments where a folding rim assembly also incorporates a break-away mechanism, openings for the retaining pin in the side flanges may be elongated and/or oval shaped to allow some breakaway movement of the rim during play.

In an aspect which may be combined or use separately from the folding aspect of the rim assembly, a breakaway mechanism may incorporate an elongate rim leaf spring. The rim leaf spring has a lower end anchored to the mounting bracket. The leaf spring extends upward and a middle portion curves forward. The middle portion may abut the axle, which forces the leaf spring to maintain a curved orientation. An upper end of the rim leaf spring abuts the rim bracket in the playing position. The rim leaf spring biases the rim bracket upward and resists downward pivotal movement, for instance due to a player hanging from the rim.

In certain embodiments the path of the unflexed leaf spring extends slightly above a plane defined by the rim bracket's playing position, so that the spring contacts the rim bracket and applies a preload as the rim bracket approaches and is placed into the playing position.

Figure 2:
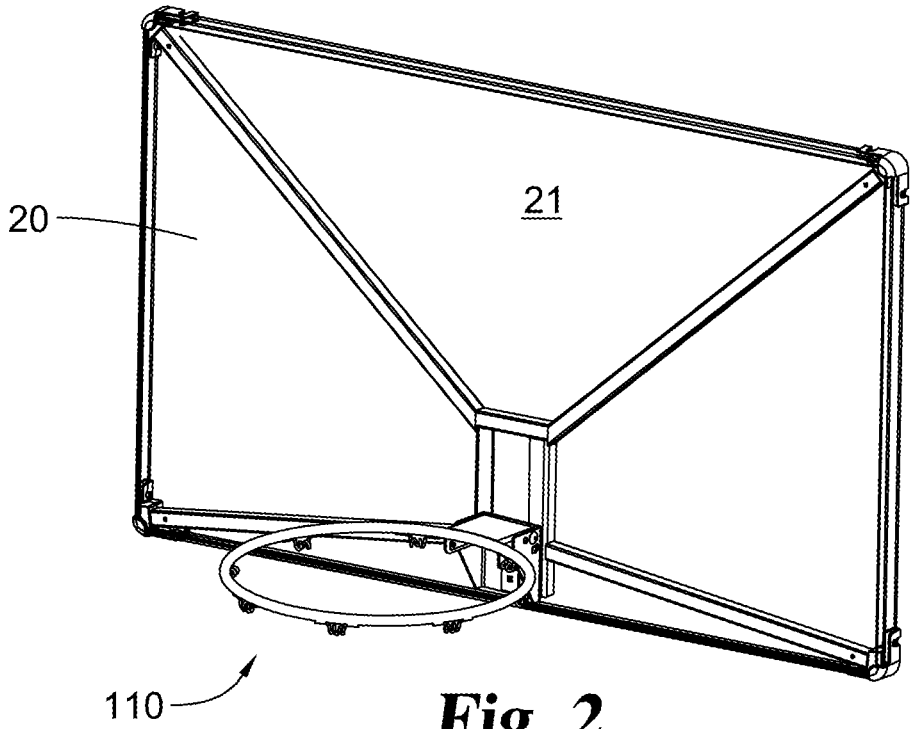
FIG. 2 is a perspective view of a basketball backboard and rim assembly incorporating an embodiment of the present disclosure with the rim assembly in the playing position.
Figure 3:
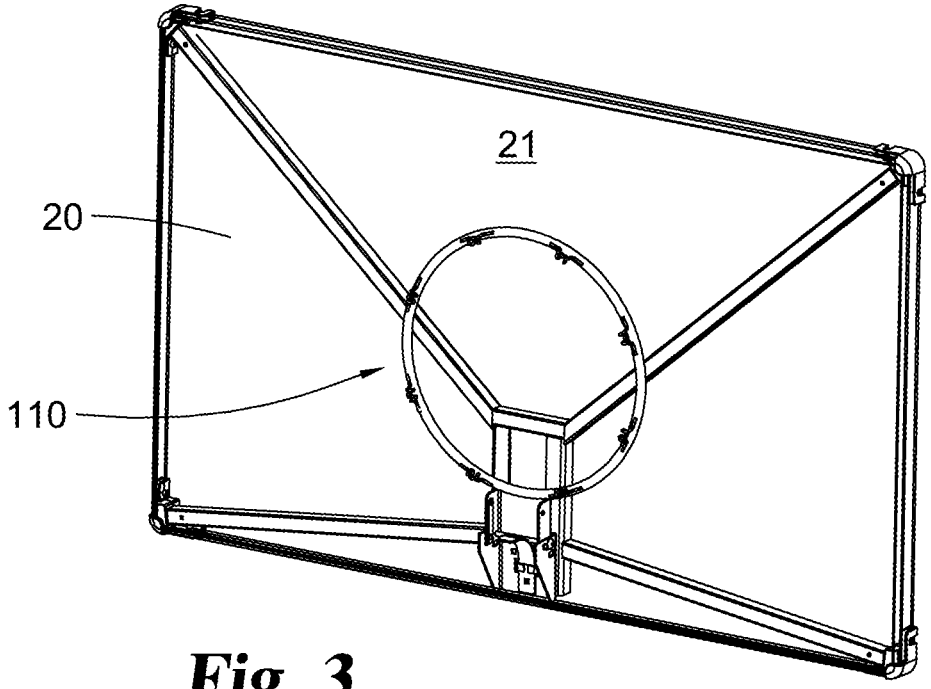
FIG. 3 is a perspective view of the basketball backboard and rim assembly of FIG. 2 in the folded position.

FIG. 1 representatively illustrates a basketball goal assembly 10. Basketball goal assembly 10 includes a backboard assembly 20 with a backboard panel 21 and a support member such as support pole 30. Rim assembly 110 extends from backboard assembly 20. FIGS. 1-3 illustrate backboard panel 21 as transparent for ease of illustration. Backboard panel 21 may be transparent such as when made from acrylic, polycarbonate or glass or may be opaque such as when made from plastic, tinted glass, wood or other materials as desired in a particular embodiment.

In some embodiments, support pole 30 may be monolithic; however, in other embodiments, support pole 30 may include two or more portions connected together. Support pole 30 may have a curved cross-section such as a circular or oval shape, a rectangular cross-section, or it may have a cross-section of any other desired shape.

The lower portion 32 of support pole 30 is mounted relative to the support surface, for example by being attached to a base 60. Base 60 may be portable. Support pole 30 may be angled so pole 30 extends obliquely from base 60 relative to the support surface. In other embodiments support pole 30 is vertical and extends perpendicular to the support surface. In some embodiments, pole 30 may be secured directly into the ground or to a base anchored in the ground. In other embodiments, backboard assembly 20 may be mounted to a wall or from a ceiling.

In the illustrated embodiment, a support system extends between backboard assembly 20 and an upper portion 34 of support pole 30. As shown in FIG. 1, the support system includes at least one and preferably a pair of lower support arms 42 and at least one and preferably a pair of upper support arms 44. Support arms 42, 44 extend parallel to each other between backboard assembly 20 and support pole 30. When used in pairs, one lower support arm 42 is located on one side of support pole 30 and another lower support arm 42 is located on the opposite side of support pole 30. Support arms 42, 44, may have a square cross-section, a rectangular cross-section, a circular cross-section, or a cross-section of any other desired shape. Some support arms may be tubular, forming a hollow interior portion and some support arms may be a solid tube or plate.

Support arms 42, 44 create a deformable parallelogram assembly for adjusting the backboard height. Rearward points on support arms 42, 44 may each be pivotally attached to support pole 30 along a vertical axis forming the rearward side of the parallelogram. Forward ends of support arms 42, 44 may each be pivotally attached to backboard assembly 20 along a vertical axis. The forward ends of the support arms may be attached directly to a rearward side of backboard assembly 20 or alternately the forward ends may be attached to a bracket 46 to which backboard assembly 20 is secured. Depending on the embodiment, backboard assembly 20 may be secured to bracket 46 either before or after the support arms 42, 44 are attached to bracket 46. The backboard assembly 20 and/or bracket 46 is vertical and forms the forward side of the deformable parallelogram.

Optionally, the ends of one or more support arms 42, 44 may extend rearward past support pole 30 and may provide attachment points for additional features of basketball goal assembly 10. For example, a height adjustment mechanism (not shown) may be attached between lower support arms 42 and a central portion of pole 30. In one example, the height adjustment mechanism may be a worm gear/piston cylinder based mechanism with a manual crank for adjustment. A balancing structure, such as springs or weights in or on the support arms, may help keep the backboard weight close to neutrally balanced relative to the pole so that it takes a minimum force applied to the rear of the support arms to raise or lower the backboard.

As illustrated in FIGS. 1-3, rim assembly 110 extends from backboard assembly 20. FIGS. 2-3 illustrate backboard assembly 20 and rim assembly 110 without support pole 30 or base 60 for ease of illustration. FIGS. 2-3 also represent embodiments where backboard assembly 20 is not mounted to a support pole, such as when backboard assembly is wall mounted.

FIG. 2 illustrates rim assembly 110 in the down or playing position. In the playing position, rim assembly 110 extends forward with the rim generally in a plane perpendicular to backboard panel 21. FIG. 3 illustrates rim assembly 110 in the up or folded position. In the folded position, rim assembly 110 extends upward with the rim generally in a plane parallel and adjacent to backboard panel 21.

Details of a representative embodiment of rim assembly 110 are illustrated further in FIGS. 4-8. Rim assembly 110 includes a base or mounting bracket 120 that is configured to be mounted to a backboard assembly. Base or mounting bracket 120 includes a vertical and planar rear portion 122. Rear portion 122 may define one or more, and preferably at least two or more, mounting openings 121. Fasteners such as bolts may extend through mounting openings 121 to secure mounting bracket 120 to backboard assembly 20. Rear portion 122 is parallel to and aligned with the front surface of backboard panel 21. In some embodiments rear portion 122 abuts the front surface of backboard panel 21. In other embodiments, backboard panel 21 may define a cut-out area around bracket 120, allowing mounting bracket 120 to be mounted directly to the backboard assembly support structure. Optionally, in cut-out embodiments, a spacer may be used to align the rear face of mounting bracket 120 with the front face of backboard panel 21.

Mounting bracket 120 includes side flanges 124 which are bent forward relative to rear portion 122. Side flanges 124 are planar and extend vertically. Side flanges 124 are perpendicular to rear portion 122. Side flanges 124 define a pair of aligned mounting axle openings, at least one and optionally a pair of aligned folded position openings 152 illustrated as circular and at least one and optionally a pair of playing position openings 154 illustrated in the shape of an elongated slot or oval.

Rim assembly 110 further includes rim bracket 130. Rim bracket 130 includes a planar top portion 132. A circular rim 140 extends outward and forward from top portion 132. Rim 140 is secured in a plane with top portion 132, for example by welding. Rim 140 may be of a conventional size for the game of basketball and may include mounting hooks for a net. Rim bracket 130 includes side flanges 134 which are bent forward relative to top portion 132. Side flanges 134 extend vertically and are perpendicular to top portion 132. Side flanges 134 are parallel to side flanges 124 of mounting bracket 120. Side flanges 134 define a pair of aligned mounting axle openings, at least one and optionally a pair of aligned folding spring mounting openings 162 and at least one and optionally a pair of aligned folding spring button openings 164.

As assembled, rim bracket 130 is nested between side flanges 124 of mounting bracket 120. The axle openings of rim bracket 130 and mounting bracket 120 are aligned, with rim bracket 130 pivotally mounted to mounting bracket 120 via an axle 144 extending through the aligned axle openings. Axle 144 is preferably locked at each end, for example with a cap, a fastener or a stamped end, to prevent unintended removal of axle 144. Rim bracket 130 is pivotal relative to mounting bracket 120 around the axis of axle 144. In the playing position, top portion 132 of rim bracket 130 is perpendicular to rear portion 122 of mounting bracket 120. Correspondingly, in the folded position, top portion 132 of rim bracket 130 is parallel to rear portion 122 of mounting bracket 120. Additionally in the playing position, the outer face 133 of top portion 132 is flush with upper edge 128 of mounting bracket 120. Ideally for safety, there are minimal gaps between rim bracket 130 and upper edge 128 of mounting bracket 120 in the playing position, yet allowing sufficient clearance for rim assembly 110 to rotate between the playing position and the folded position when desired.

In the illustrated embodiment, rim assembly 110 includes a locking mechanism to selectively retain the bracket in the folded position or the playing position. Illustrated in detail in FIGS. 5-6, the locking mechanism includes at least one and optionally a pair of folding springs 170, i.e. springs operable in folding the rim assembly. Folding springs 170 are leaf springs based on elongate, planar metal strips 171. In the illustrated embodiment, each folding spring 170 is mounted parallel and adjacent to an interior face of a side flange 134 of rim bracket 130. Other arrangements can also be used. A mounting end of each leaf spring is secured to side flange 134, for instance with a mounting stud 172 secured within a mounting opening 162. Mounting stud 172 may be secured within mounting opening 162 frictionally, for example via a snap fit, or alternately fastened with a screw, bolt, rivet, weld, adhesive, or the like. Mounting stud 172 may extend into mounting opening 162 and optionally slightly outward, yet does not protrude sufficiently to interfere with rotation of the bracket pieces.

A retaining piece such as locking button 174 is arranged at an opposing end of strip 171 from mounting stud 172. Locking button 174 is perpendicular to the plane of strip 171 and extends into a folding spring button opening 164 of rim bracket 130. Each locking button 174 has a height or thickness at least sufficient to engage the combined thicknesses of flanges 124 and 134 and optionally may extend slightly outward beyond flange 124.

Locking button 174 is arranged to sequentially align with folded position opening 152 and playing position opening 154 defined in side flange 124 during rotation of rim bracket 130 relative to mounting bracket 120. As one arrangement, the locking button can be arranged to travel at a fixed radius offset from the axis of axle 144. When locking button 174 comes into alignment with either folded position opening 152 or playing position opening 154, the folding spring biases locking button 174 laterally outward so that the height of locking button 174 extends through both side flanges 124 and 134, whereupon the shear strength of the locking button locks the side flanges, preventing further rotational movement until locking button 174 is disengaged.

The rim assembly can be unlocked by resiliently pressing the locking buttons inward from the locking openings. Strip 171 has a sufficient length, flexibility and clearance to allow locking button 174 to be resiliently pressed inward against the biasing force of folding spring 170 a sufficient distance that locking button 174 disengages from the currently aligned opening in mounting bracket side flange 124, enabling rotation of rim bracket 130 relative to mounting bracket 124.

Embodiments of the rim assembly may incorporate a breakaway mechanism. A breakaway mechanism allows the rim bracket to resiliently rotate slightly downward when force is applied to the rim and causes the rim bracket to return to a static position when the force is released.

In the embodiment illustrated in FIGS. 5-8, rim assembly 110 incorporates a break-away mechanism using rim leaf spring 180, i.e. a leaf spring operable to resist movement of the rim. Rim leaf spring 180 may be used in basketball rim embodiments with or without a folding bracket and/or locking mechanism arrangement.

As used herein, a leaf spring means an elongate beam or flat type of spring such as a strip of a substantially planar sheet or plate material with an elongated length, a width and a thickness. The strip maintains a fixed shape along its length, either a curved or a flat shape, in an unflexed state. The strip has a spring strength that resists being flexed, yet when flexed the strip is biased to return to an un-flexed shape. Rim leaf spring 180 may be made of high strength metal materials which are flexible yet with significant spring strength such steel, stainless steel or aluminum. In alternate embodiments, rim leaf spring may be made of a strip of non-metal material such as a plastic or rubber with a sufficient flexibility and spring strength.

Rim leaf spring 180 has a lower end 182 which converges with and becomes parallel to abut the inner face of mounting bracket rear portion 122. Lower end 182 may be anchored to rear portion 122, for example with a pair of clamping tabs 126. When installed on a backboard assembly, lower end 182 may be further anchored with a fastener, such as a bolt, extending through a mounting opening 183 aligned with a bracket mounting opening 121. The fastener may assist in securing the spring and the bracket to the backboard assembly.

The length of rim leaf spring 180 extends upward from lower end 182, and is arranged with a mid-portion 184 which curves forward. In certain embodiments, mid-portion 184 is held in a curved orientation by axle 144, where mid-portion 184 contacts axle 144 tangentially. When used in a foldable rim assembly as illustrated, leaf spring 180 is retained in the curved orientation by the combination of anchored lower end 182 and abutment against axle 144 regardless of whether rim assembly 110 is in the playing position or the folding position.

The length of rim leaf spring 180 continues to extend upward from mid-portion 184 to upper end 186. Upper end 186 continues the curve of mid-portion 184, and may transition to a flat portion which is substantially horizontal.

Figure 8:
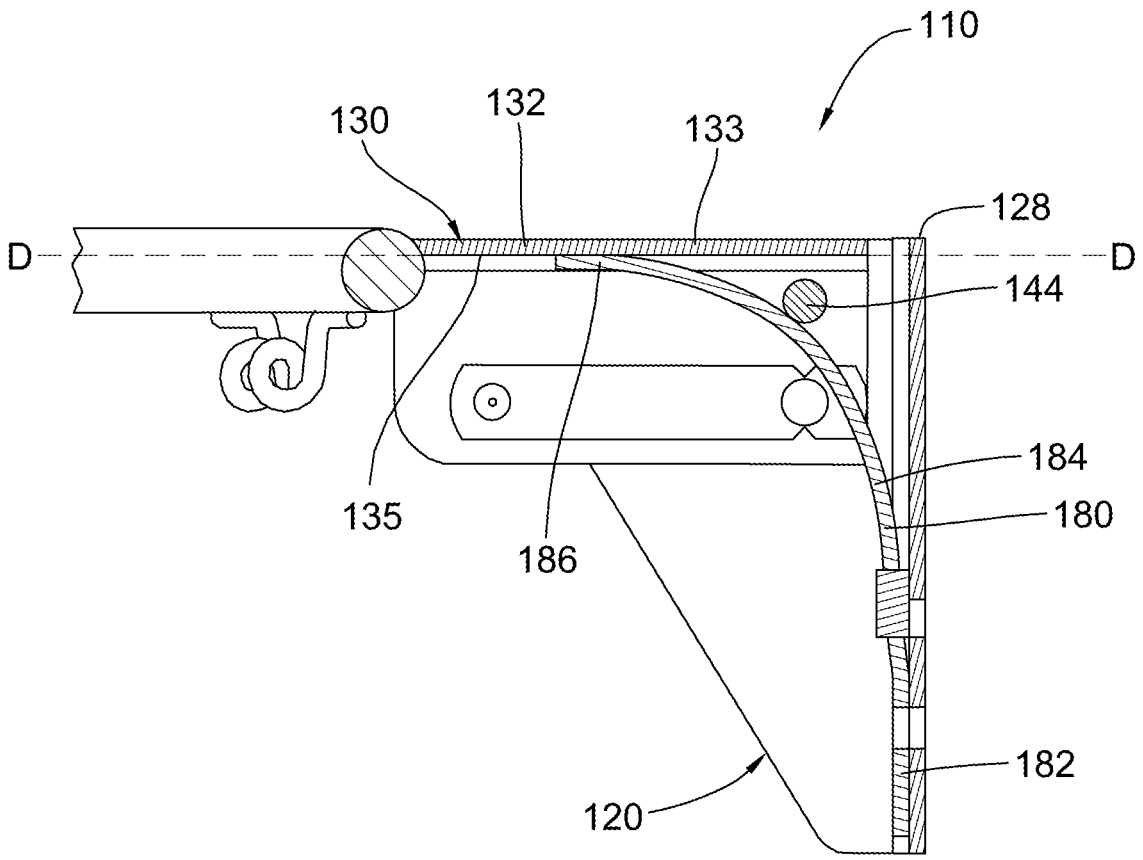
FIG. 8 is a cross-sectional view of the rim assembly of FIG. 2 in the playing position.
Figure 9:
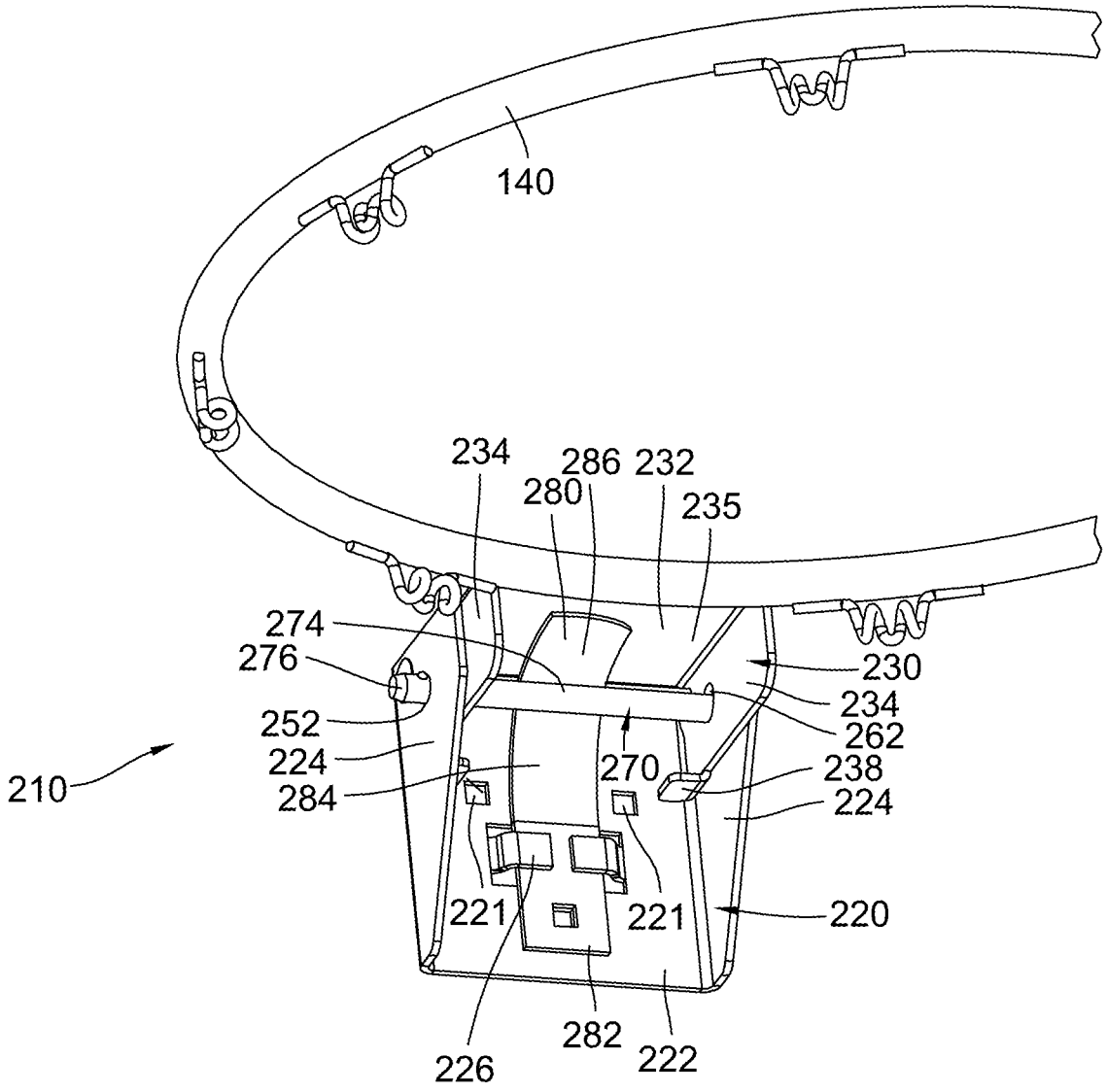
FIG. 9 is a perspective view of an alternate embodiment of a rim assembly in the playing position.
Figure 10:
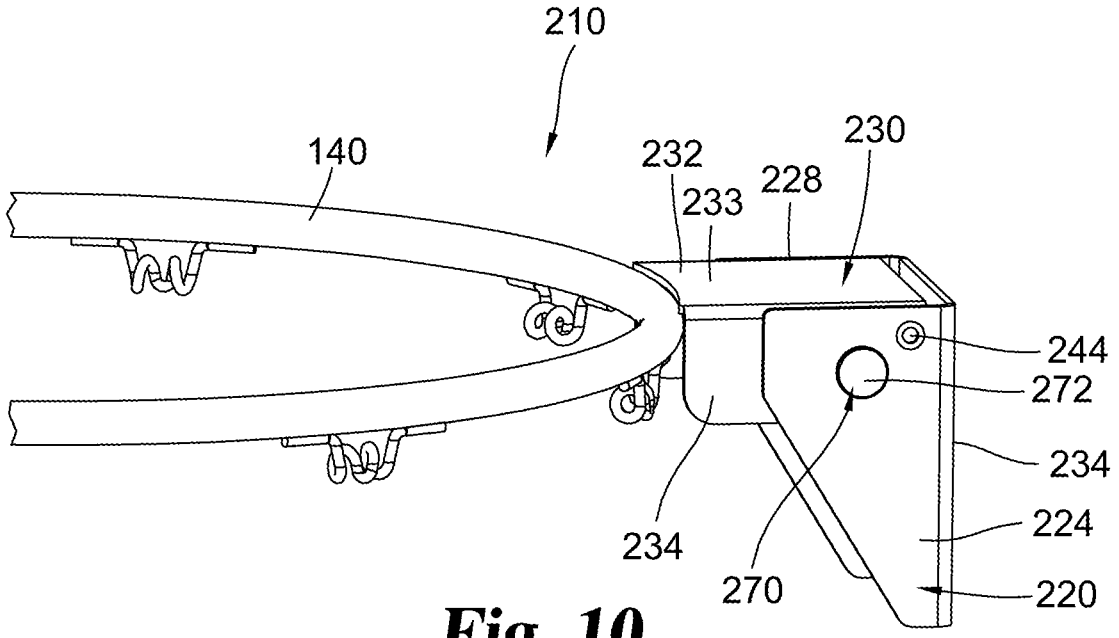
FIG. 10 is side view of the rim assembly of FIG. 9.

As illustrated in cross-section in FIG. 8, in the playing position upper end 186 abuts and may be depressed by an inner face 135 of the rim bracket top portion 132. Upper end 186 engages rim bracket 130 along horizontal plane D-D abutting inner face 135. Plane D-D may be arranged below mounting bracket upper edge 128 by the thickness of rim bracket top portion 132. Rim leaf spring 180, via engagement of upper end 186, biases rim bracket top portion 132 to at least the horizontal position and resiliently resists downward pivotal movement of rim bracket 130 and rim 140, for instance when a player impacts or hangs from rim 140. When rim 140 is rotated downward under an applied force, leaf spring 180 is flexed, biasing rim 140 to return to a static playing position when the force is removed.

Figure 7:
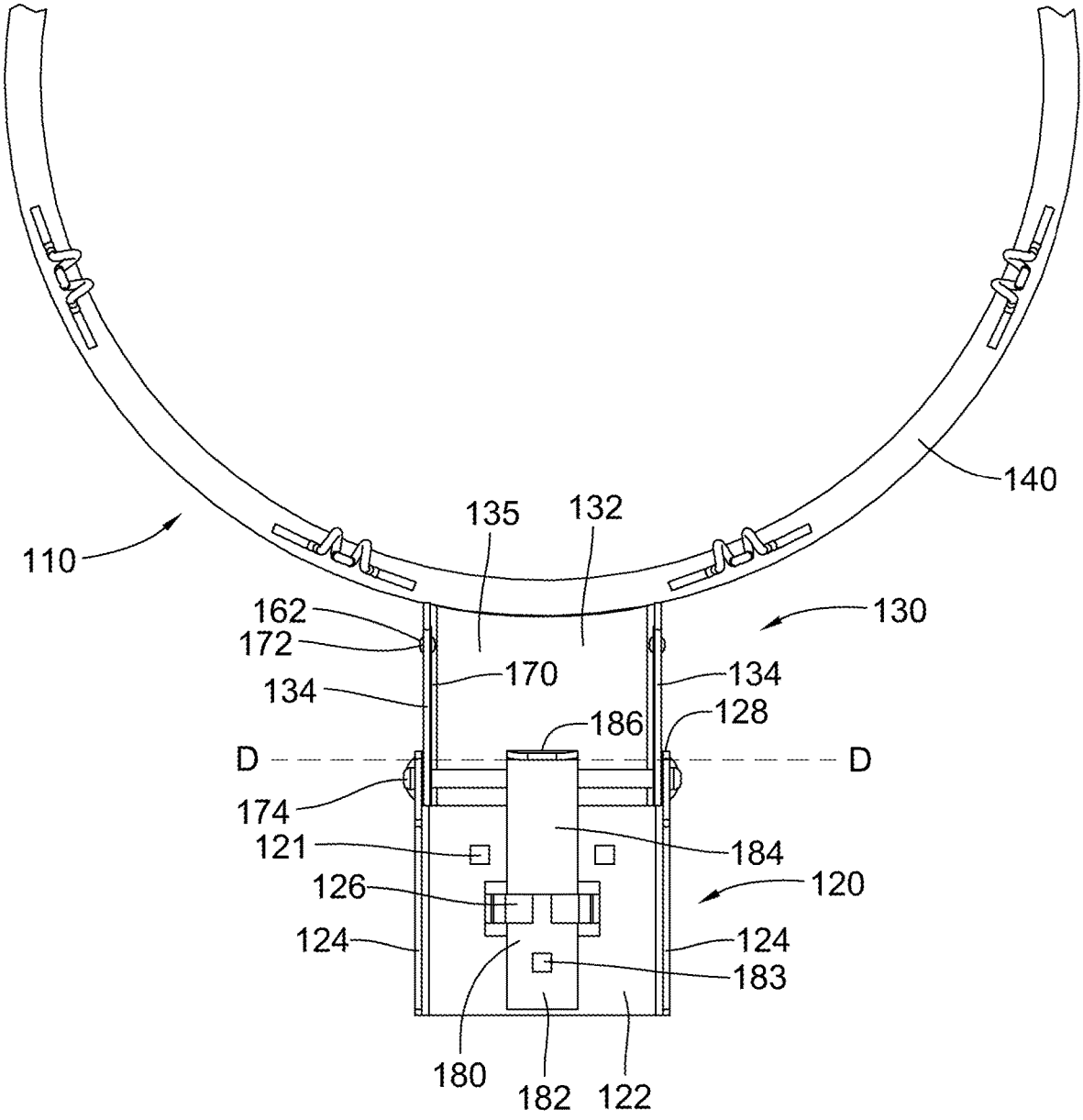
FIG. 7 is a front view of the rim assembly of FIG. 2 in the folded position.

In certain embodiments, the unflexed path of leaf spring upper end 186 does or would extend to a vertical height higher than plane D-D, as illustrated for example in FIG. 7. Depending on the embodiment, the unflexed height of upper end 186 may be less than, equal to or greater than the upper edge 128 of mounting bracket 120. When rim leaf spring 180 is installed against a rim bracket in a non-folding rim assembly or when folding rim assembly 110 is rotated into the playing position, inner face 135 contacts and slightly flexes upper end 186 downward, applying an initial force or pre-load onto the leaf spring 180 and correspondingly a resistive force to rim bracket 130. Among other advantages, this pre-load helps hold rim bracket 130 in position and helps prevent unintended movement or rattle of the rim assembly.

When a break-away mechanism using rim leaf spring 180 is used in combination with a folding rim assembly as illustrated, the folding and locking arrangement needs to accommodate the break-away action. In the representative embodiment, this is accommodated via the shape of playing position openings 154. In example embodiments, playing position openings 154 are defined each with an elongated slot or oval.

Figure 4:
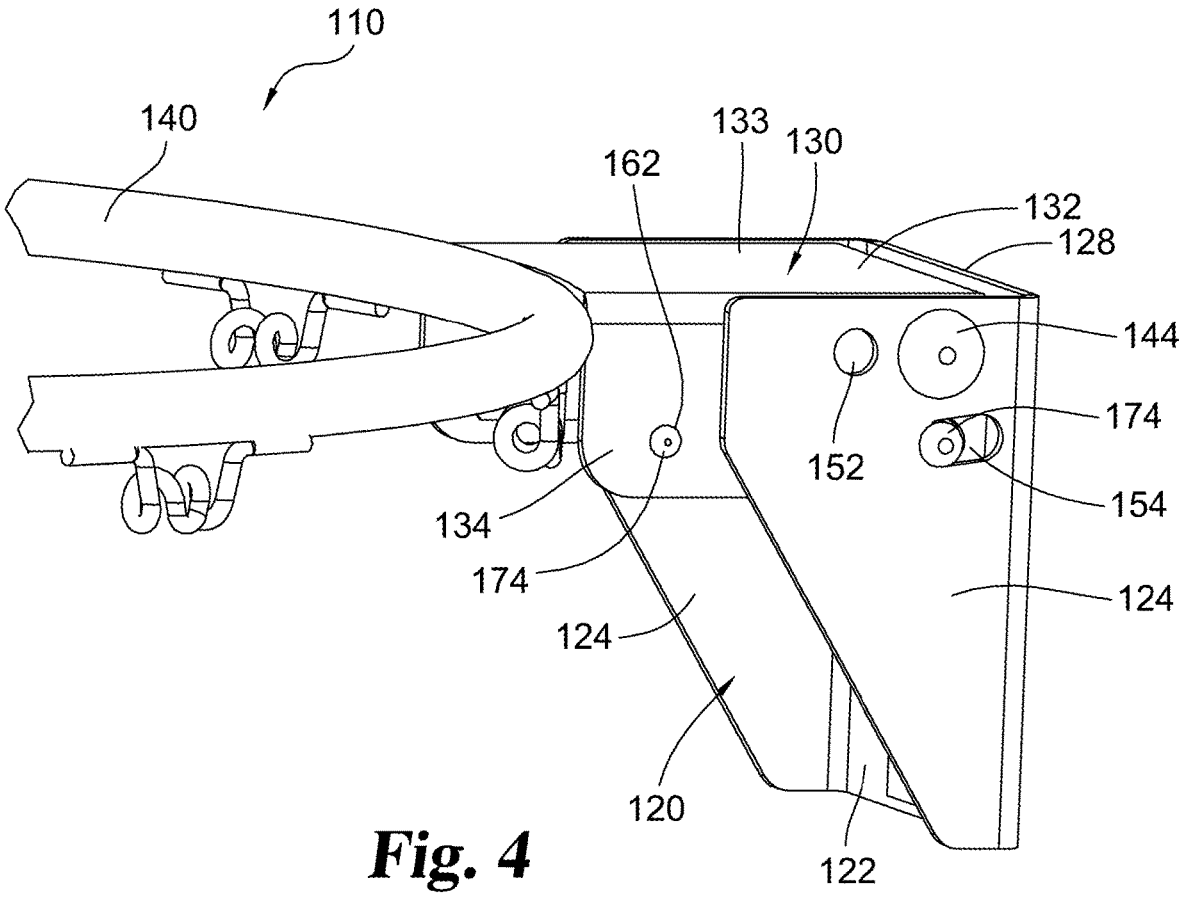
FIG. 4 is a perspective view of the rim assembly of FIG. 2 in the playing position.
Figure 5:
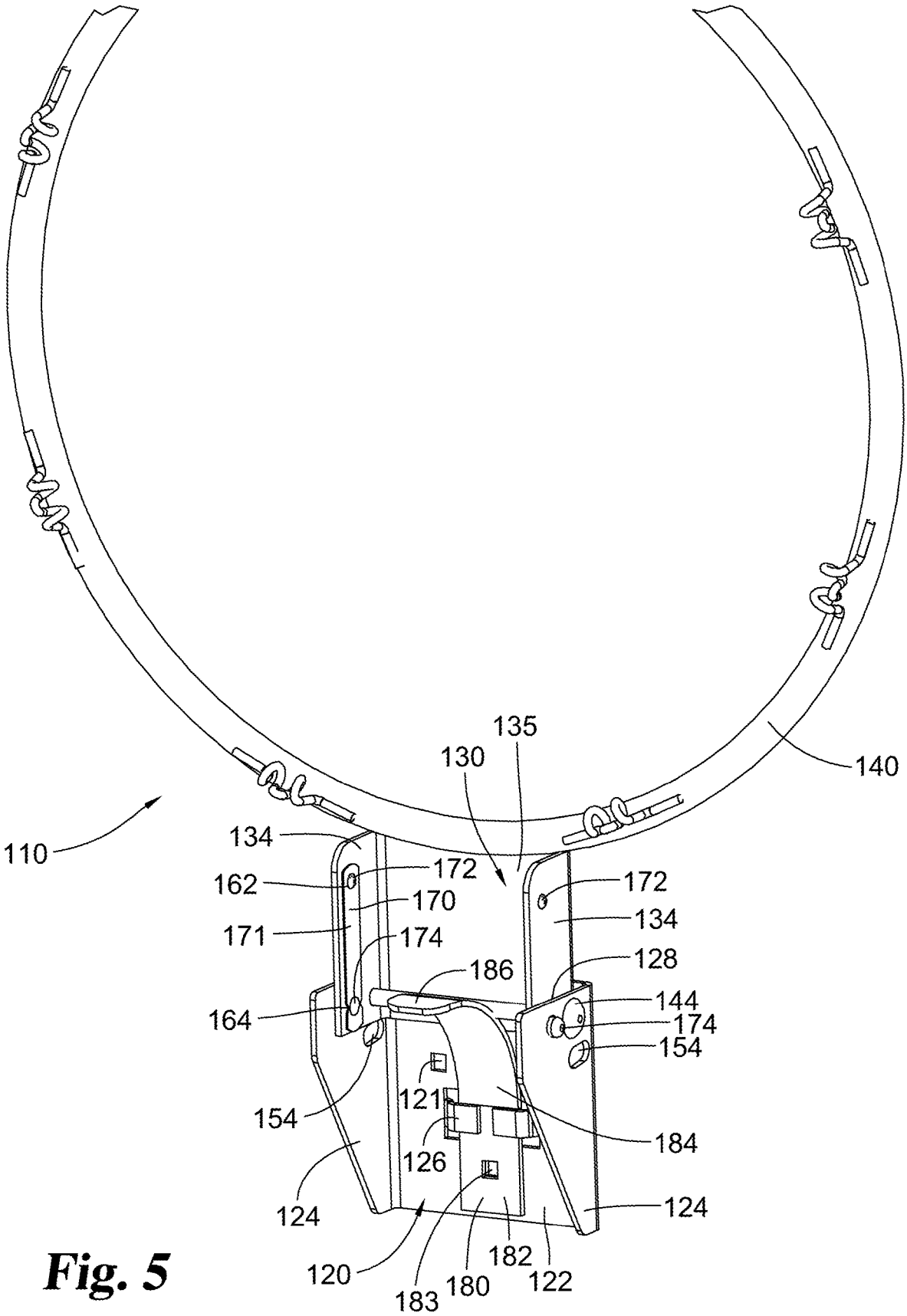
FIG. 5 is a perspective view of the rim assembly of FIG. 2 in the folded position.
Figure 6:
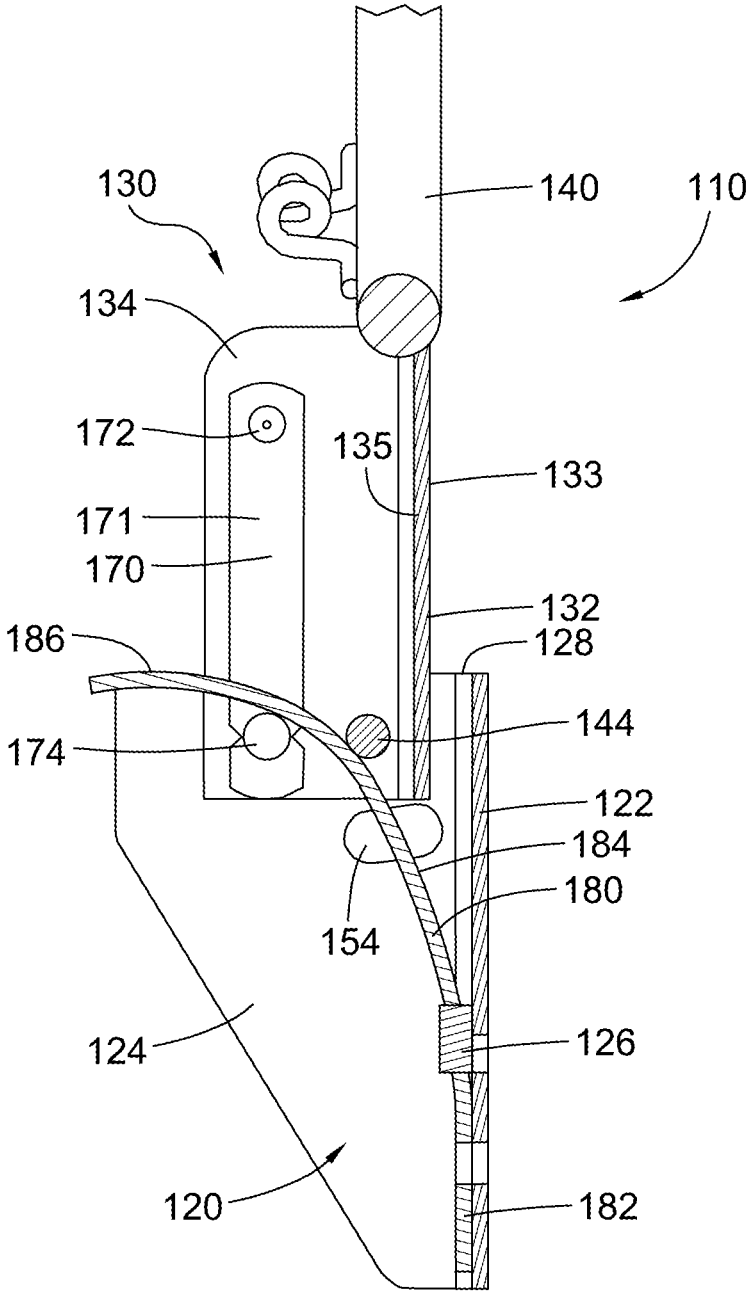
FIG. 6 is a cross-sectional view of the rim assembly of FIG. 2 in the folded position.

As illustrated in detail in FIG. 4, in the playing position locking button 174 extends through the side flange 134 of rim bracket 130 and further extends so that the height of locking button 174 engages playing position opening 154 in mounting bracket side flange 124. The abutting engagement of locking button 174 against the forward edge of playing position opening 154 prevents rim bracket 130 from rotating upward toward the folded position until locking button 174 is disengaged. Correspondingly, it prevents the pre-load of rim leaf spring 180 from pushing rim 140 above a horizontal orientation. When combined in an embodiment where rim leaf spring 180 is subject to a pre-load, locking button 174 is urged against the forward edge of playing position opening 154 in the static playing position.

Additionally, the elongated or oval shape of playing position opening 154 allows the retaining piece such as locking button 174 to translate within playing position opening 154 when the rim 140 and rim bracket 130 pivot forward and downward under a break-away movement. This translation movement allows the rim bracket to pivot slightly downward separately yet in addition to the ability to fold the rim assembly upward. Upon release of the break-away force, rim leaf spring 180 urges rim bracket 130 upward to the static position and returns locking button 174 to abut the forward edge of playing position opening 154. In example embodiments, the elongated slot or oval defined by playing position openings 154 has a major axis which is substantially horizontal, optionally with a slight angle and/or a slight radial curve to accommodate radial movement of locking button 174 as rim bracket 130 rotates.

Details of an alternate embodiment of a rim assembly 210 are illustrated in FIGS. 9-13. Rim assembly 210 can be used with and mounted to backboard assembly 20 in the same manner as rim assembly 110. Rim assembly 210 includes a base or mounting bracket 220 that is configured to be mounted to a backboard assembly. Base or mounting bracket 220 includes a vertical and planar rear portion 222. Rear portion 222 defines one or more, and preferably at least two or more, mounting openings 221. Fasteners such as bolts may extend through mounting openings 221 to secure mounting bracket 220 to backboard assembly 20. Rear portion 222 is parallel to and aligned with the front surface of backboard panel 21. In some embodiments rear portion 222 abuts the front surface of backboard panel 21. In other embodiments, backboard panel 21 may define a cut-out area around bracket 220, allowing mounting bracket 220 to be mounted directly to the backboard assembly support structure. Optionally, in cut-out embodiments, a spacer may be used to align the rear face of mounting bracket 220 with the front face of backboard panel 21.

Mounting bracket 220 includes side flanges 224 which are bent forward relative to rear portion 222. Side flanges 224 are planar and extend vertically. Side flanges 224 are perpendicular to rear portion 222. Side flanges 224 define a pair of aligned mounting axle openings and a pair of aligned outer pin openings 252 illustrated as circular in shape.

Rim assembly 210 further includes rim bracket 230. Rim bracket 230 includes a planar top portion 232. In the same manner as in rim assembly 110, rim 140 extends outward and forward from top portion 232. Rim bracket 230 includes side flanges 234 which are bent relative to top portion 232. Side flanges 234 extend vertically and are perpendicular to top portion 232. Side flanges 234 are parallel to side flanges 224 of mounting bracket 220. Side flanges 234 define a pair of aligned mounting axle openings and a pair of aligned inner pin openings 262 illustrated as elongated or oval in shape.

As assembled, rim bracket 230 is nested between side flanges 224 of mounting bracket 220. The axle openings of rim bracket 230 and mounting bracket 220 are aligned, with rim bracket 230 pivotally mounted to mounting bracket 220 via an axle 244 extending through the aligned axle openings. Axle 244 is preferably locked at each end, for example with a cap, a fastener or a stamped end, to prevent unintended removal of axle 244. Rim bracket 230 is pivotal relative to mounting bracket 220 around the axis of axle 244. In the playing position, top portion 232 of rim bracket 230 is perpendicular to rear portion 222 of mounting bracket 220. Correspondingly, in the folded position, top portion 232 of rim bracket 230 is parallel to rear portion 222 of mounting bracket 220. Additionally in the playing position, the outer face 233 of top portion 232 is substantially flush with upper edge 228 of mounting bracket 220. Ideally for safety, there are minimal gaps between rim bracket 230 and upper edge 228 of mounting bracket 220 in the playing position, yet allowing sufficient clearance for rim assembly 210 to rotate between the playing position and the folded position when desired.

In the illustrated embodiment, rim assembly 210 includes a locking mechanism to selectively retain the assembly in the folded position or the playing position. Illustrated in detail in FIGS. 9-11, the locking mechanism includes a retaining piece such as retaining pin 270. The illustrated embodiment of retaining pin 270 is an elongated metal shaft or bolt, although other styles of retaining pins may be used. With rim assembly 210 in the playing position. Opposing ends of retaining pin 270 extend laterally through the aligned pairs of outer pin openings 252 and inner pin openings 262 in the respective pairs of side flanges 224 and 234. In the illustrated embodiment, retaining pin 270 includes a cap end 272 which prevents one end of retaining pin 270 from passing through the pin openings. A fastener could be used instead of a cap in alternate embodiments. A shaft portion 274 extends across the width of bracket 220 and a distal end 276 exits from mounting bracket 220 on a side opposite to cap end 272. The distal end 276 can be selectively secured with a fastener to prevent unintended removal of retaining pin 270. Example fastener options for securing distal end 276 include a retractable ball bearing, a cross-pin, a wire or ring, a removable cap or a nut secured to a threaded distal end of the retaining pin. Alternate options for selectively securing distal end 276 can also be used.

Retaining pin 270 can be selectively installed in rim assembly 210 to hold rim assembly 210 in the playing position. When desired, retaining pin 270 can be removed, allowing rim assembly 210 to be folded by rotating bracket 230 and rim 140 upward. Retaining pin 270 is removed in FIGS. 12-13.

In the embodiment illustrated in FIGS. 9-13, rim assembly 210 incorporates a break-away mechanism using rim leaf spring 280. Rim leaf spring 280 is comparable in mounting and operation to rim leaf spring 180. Rim leaf spring 280 has a lower end 282 which abuts the inner face of mounting bracket rear portion 222. Lower end 282 may be anchored to rear portion 222, for example with a pair of clamping tabs 226. Rim leaf spring 280 extends upward with a mid-portion 284 which curves forward. In certain embodiments, mid-portion 284 is held in a curved orientation by axle 244, where mid-portion 284 contacts axle 244 tangentially. Leaf spring 280 may be retained in the curved orientation by the combination of anchored lower end 282 and abutment against axle 244 regardless of whether rim assembly 210 is in the playing position or the folding position. Rim leaf spring 280 continues to upper end 286.

Figure 11:
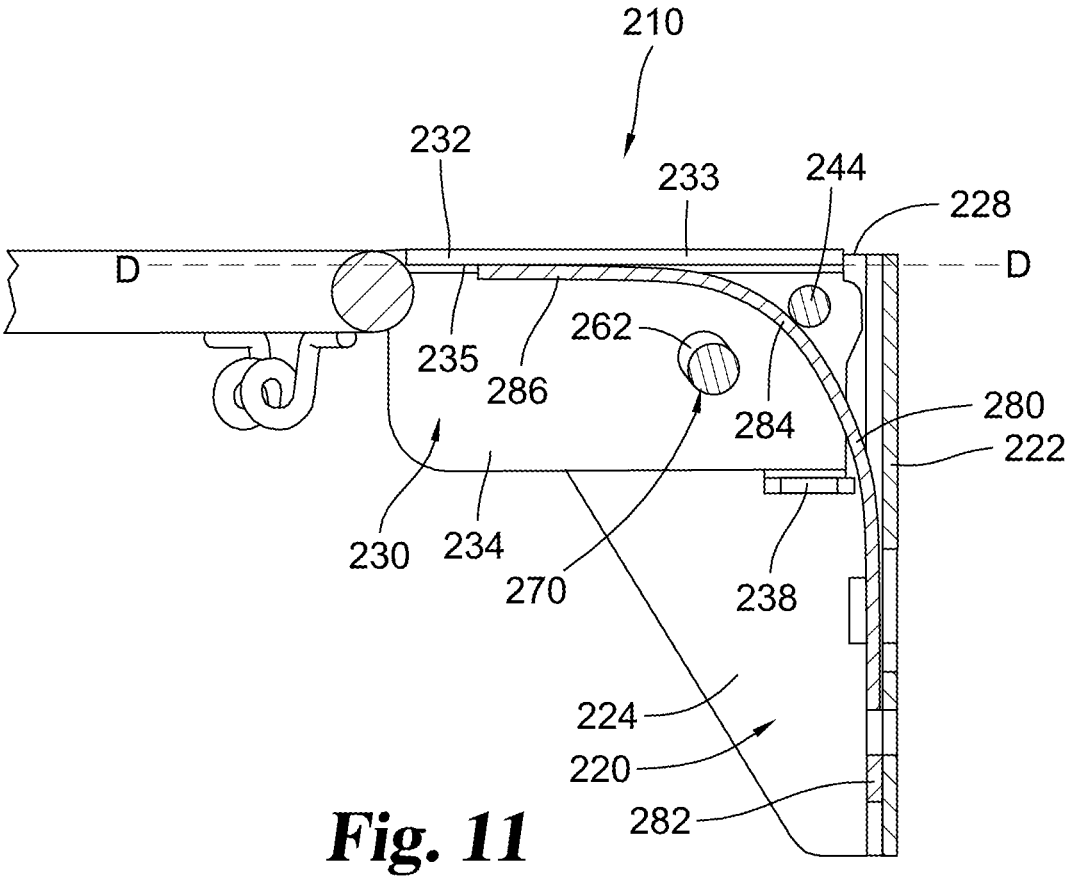
FIG. 11 is a cross-sectional view of the rim assembly of FIG. 9 in the playing position.
Figure 12:
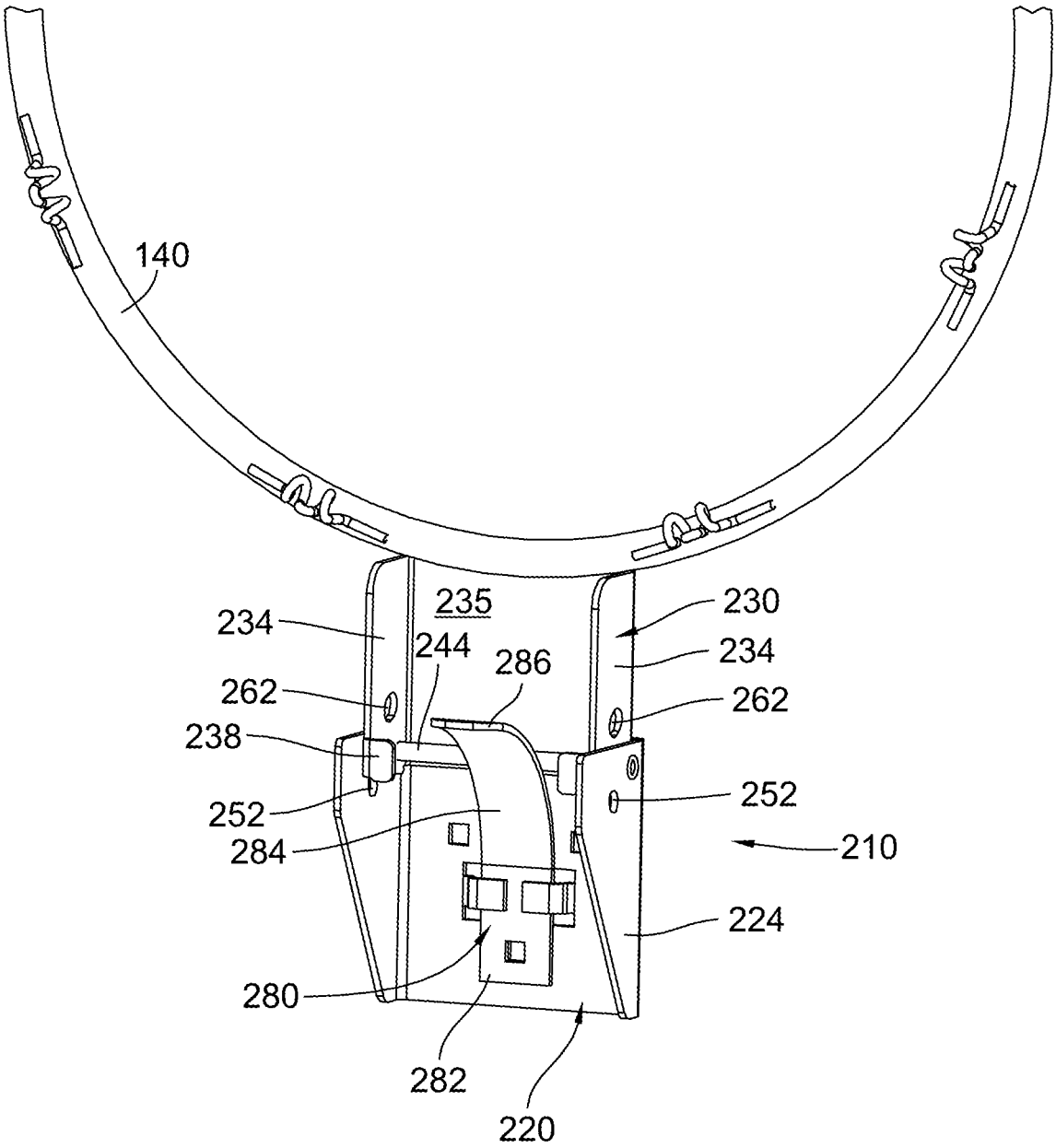
FIG. 12 is a perspective view of the rim assembly of FIG. 9 in the folded position.

As illustrated in cross-section in FIG. 11, in the playing position upper end 286 abuts and may be depressed by an inner face 235 of the rim bracket top portion 232 along horizontal plane D-D. Rim leaf spring 280 biases rim bracket top portion 232 to at least the horizontal position and resiliently resists downward pivotal movement of rim bracket 230 and rim 140. When rim 140 is rotated downward under an applied force, leaf spring 280 is flexed, biasing rim 140 to return to a static playing position when the force is removed.

Figure 13:
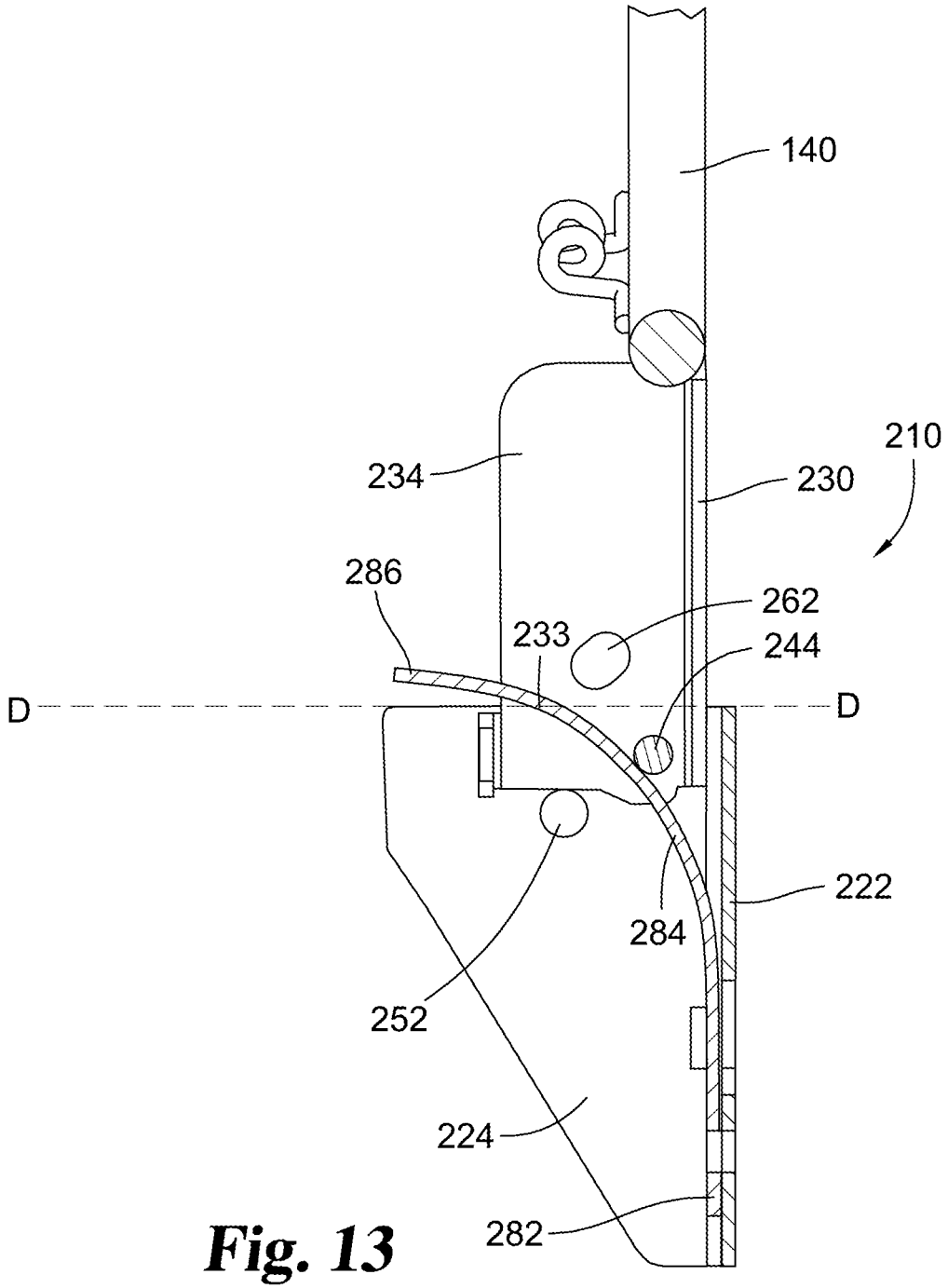
FIG. 13 is a cross-sectional view of the rim assembly of FIG. 9 in the folded position.

In certain embodiments, the unflexed path of leaf spring upper end 286 does or would extend to a vertical height higher than plane D-D, as illustrated for example in FIG. 13. Depending on the embodiment, the unflexed height of upper end 286 may be less than, equal to or greater than the upper edge 228 of mounting bracket 220. In the playing position, inner face 235 contacts and slightly flexes upper end 286 downward, applying an initial force or pre-load onto the leaf spring 280 and correspondingly a resistive force to rim bracket 230. Among other advantages, this pre-load helps hold rim bracket 230 in position and prevent unintended movement or rattle of the rim assembly.

In the embodiment of FIGS. 9-13, rim bracket 230 incorporates elongated or oval shaped inner pin openings 262. As part of the breakaway mechanism, the elongated or oval shape of pin openings 262 allows bracket 230 to slightly rotate downward when pressure is applied to rim 140 while retaining pin 270 is in place. Specifically, retaining pin 270 translates along the elongate length of inner pin openings 262 as rim bracket 230 rotates. As illustrated in FIG. 11, the major axis of oval inner pin openings 262 maybe slightly angled to be aligned with the translational path of retaining pin 270 as rim bracket 230 rotates. In some embodiments, the elongate openings may be slightly curved to accommodate the downward rotation of rim bracket 230. In alternate embodiments, outer pin openings 252 could be oval shaped instead of inner pin openings 262.

Optionally, rim bracket 230 may also incorporate stop tabs 238 extending laterally inward adjacent the lower edges of rim bracket side flanges 234. Stop tabs 238 are spaced slightly forward of mounting bracket rear portion 222 in the playing position. When rim bracket 230 is rotated downward under pressure, stop tabs 238 may rotate rearward into engagement with rear portion 222 consequently limiting further rotation.

Figure 14:
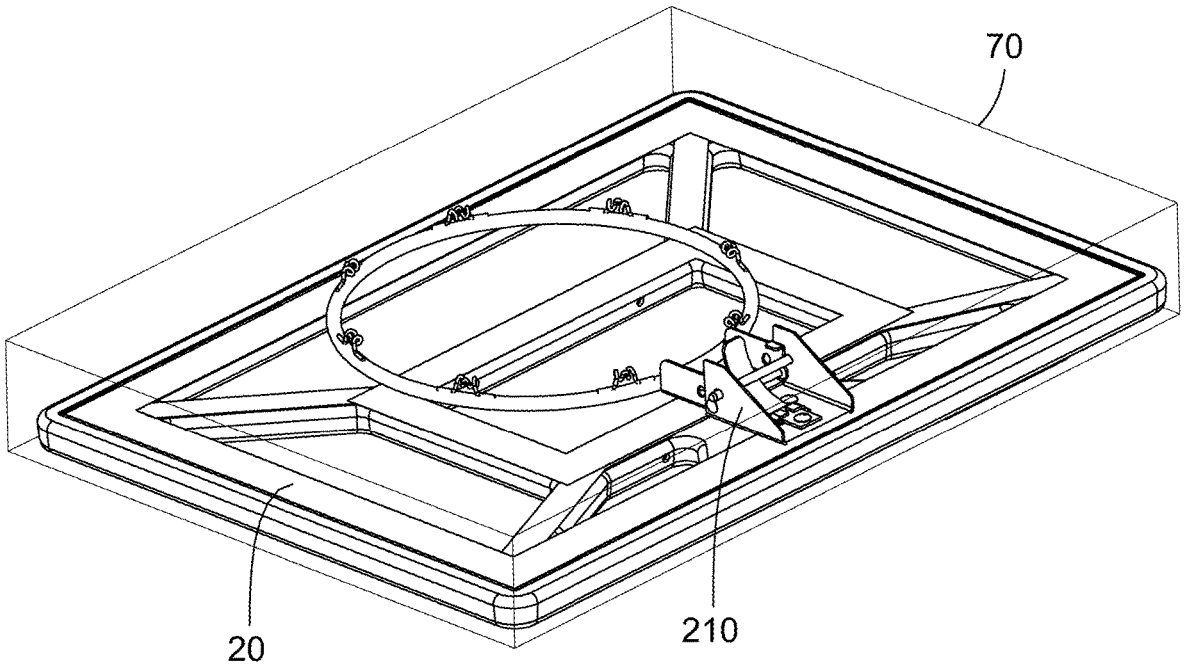
FIG. 14 is a representational view of a basketball backboard assembly and rim assembly in the folder position in a packaging container.

Folding rim assemblies using versions of the disclosed folding bracket and locking arrangement can be packaged and transported pre-mounted to certain backboard assemblies. Alternately, folding rim assemblies such as disclosed can be sold separately or packaged with a backboard for on-site mounting. As illustrated in FIG. 14, in certain embodiments a backboard assembly 20 is packaged and shipped in a package 70 with the folding rim assembly 110 or 210 arranged in an open or unfolded position within the package 70 with the basketball rim parallel to the backboard.

While the disclosure has been illustrated and described in detail in the drawings and foregoing description, the same is to be considered as illustrative and not restrictive in character, it being understood that only the preferred embodiment has been shown and described and that all changes and modifications that come within the spirit of the disclosure are desired to be protected.

What is claimed:

1. A basketball goal rim assembly, comprising:

a. a mounting bracket with a planar rear portion configured to be mounted to a basketball backboard with the rear portion parallel to the backboard;

b. a rim bracket pivotally connected to the mounting bracket;

c. a basketball rim extending from the rim bracket;

d. wherein the rim bracket is rotatable upward relative to the mounting bracket between a playing position and a folded position, wherein in the playing position the basketball rim extends perpendicular to the planar rear portion and in the folded position the basketball rim extends parallel to the planar rear portion;

e. a breakaway mechanism arranged between the mounting bracket and the rim bracket wherein the breakaway mechanism allows the rim bracket to rotate slightly downward when force is applied to the basketball rim and causes the rim bracket to return to a static position when the force is released; and, f. a locking mechanism to selectively retain the rim assembly in the folded position or the playing position, wherein the locking mechanism includes a pair of locking buttons on the ends of respective leaf springs mounted to the rim bracket, wherein the locking buttons resiliently extend laterally through openings in side flanges of the rim bracket.

2. The basketball goal rim assembly of claim 1, wherein in the folded position the locking buttons extend through respective folded position openings of the mounting bracket and wherein in the playing position the locking buttons extend through playing position openings in side flanges of the mounting bracket.

3. The basketball goal rim assembly of claim 2, wherein the playing position openings are oval shaped allowing translation of the locking buttons within the playing position openings.

4. The basketball goal rim assembly of claim 1, wherein the breakaway mechanism comprises an elongate rim leaf spring having a lower end anchored to the mounting bracket, wherein the leaf spring extends upward and curves to an upper end which abuts against the rim bracket in the playing position, wherein the rim leaf spring biases the rim bracket upward.

5. The basketball goal rim assembly of claim 4, wherein the rim bracket is pivotally mounted to the mounting bracket with an axle, and wherein the rim leaf spring is retained in a curved orientation by the anchored lower end and the axle.

6. The basketball goal rim assembly of claim 4, wherein an unflexed path of the rim leaf spring extends to a vertical height higher than a plane defined by a downward facing inner face of the rim bracket in the playing position.

7. The basketball goal rim assembly of claim 4, wherein in the playing position the rim bracket applies a pre-load to the leaf spring resisting downward rotation of the rim bracket.

8. The basketball goal rim assembly of claim 1 wherein the mounting bracket rear portion is mounted to a basketball backboard.

9. A basketball goal rim assembly, comprising:

a. a mounting bracket with a planar rear portion mounted to a basketball backboard with the rear portion parallel to the backboard;

b. a rim bracket pivotally connected to the mounting bracket;

c. basketball rim extending from the rim bracket;

d. wherein the rim bracket is rotatable relative to the mounting bracket between a playing position and a folded position, wherein in the playing position the rim extends perpendicular to the planar rear portion and in the folded position the basketball rim extends parallel to the planar rear portion;

e. a selectively removable retaining pin wherein opposing ends of the retaining pin extend laterally through a pair of aligned openings defined in side flanges of the rim bracket and a pair of aligned openings defined in side flanges of the mounting bracket and wherein the openings in the side flanges of the mounting bracket hold the retaining pin in a fixed position;

f. wherein the pair of aligned openings defined in the side flanges of the rim bracket are elongated and wherein the elongated openings allow the retaining pin to translate upward with respect to the elongate length of the openings as the rim bracket pivots downward when force is applied to the basketball rim; and, g. an elongate rim leaf spring having a lower end anchored to the mounting bracket, wherein the leaf spring extends upward and curves to an upper end which abuts against the rim bracket, wherein the rim leaf spring biases the rim bracket upward.

10. The basketball goal rim assembly of claim 9, wherein an unflexed path of the rim leaf spring extends to a vertical height higher than a plane defined by a downward facing inner face of the rim bracket in the playing position so that the leaf spring applies a preload between the rim bracket and the mounting bracket as the rim bracket is placed in the playing position.

* * * * *